US009964385B1

(12) United States Patent
Genson

(10) Patent No.: US 9,964,385 B1
(45) Date of Patent: May 8, 2018

(54) SHOCK MITIGATION BODY

(71) Applicant: The United States of America as represented by the Department of the Navy, Washington, DC (US)

(72) Inventor: Kevin Genson, Waldorf, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days. days.

(21) Appl. No.: 15/330,510

(22) Filed: Sep. 30, 2016

(51) Int. Cl.
*F42B 12/22* (2006.01)
*F42B 12/76* (2006.01)
*F42B 12/20* (2006.01)

(52) U.S. Cl.
CPC ..... *F42B 12/76* (2013.01); *F42B 12/22* (2013.01); *F42B 12/20* (2013.01)

(58) Field of Classification Search
CPC ..... F42B 12/02; F42B 12/20; F42B 12/207; F42B 12/22; F42B 12/24; F42B 12/32; F42B 12/76; F42B 39/24
USPC ..... 102/491, 492; 86/50; 89/36.01, 36.02
See application file for complete search history.

(56) References Cited

U.S. PATENT DOCUMENTS

| | | | | |
|---|---|---|---|---|
| H540 | H | 11/1988 | Caponi | |
| 5,054,399 | A * | 10/1991 | Bilek | F42B 12/80 102/282 |
| 7,093,542 | B2 * | 8/2006 | Gousman | F42B 12/22 102/493 |
| 7,743,707 | B1 * | 6/2010 | Melin | F42C 19/0842 102/493 |
| 8,448,927 | B1 | 5/2013 | Falabella et al. | |
| 8,904,936 | B2 * | 12/2014 | Treadway | F42D 5/045 102/315 |
| 8,973,503 | B2 | 3/2015 | Dunaway et al. | |
| 8,978,560 | B1 * | 3/2015 | Stepanov | F42B 12/207 102/479 |
| 9,784,541 | B1 * | 10/2017 | Genson | F42B 12/24 |
| 2016/0178336 | A1 * | 6/2016 | Jennett | F42B 12/207 102/506 |
| 2017/0045335 | A1 * | 2/2017 | Abbe | F41H 5/0414 |

* cited by examiner

*Primary Examiner* — James S Bergin
(74) *Attorney, Agent, or Firm* — Fredric J. Zimmerman

(57) ABSTRACT

A shock mitigation casing includes a monolithic body made from a solid material. The monolithic body includes a first wall, a second wall spaced apart from the first wall, and axial end walls contiguous with the first wall and the second wall. A chamber is defined between the walls. A powder fills the chamber. The powder is a powdered form of the solid material.

10 Claims, 1 Drawing Sheet

SHOCK MITIGATION BODY

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to shock mitigation, and more particularly to a fully-contained shock mitigation body/casing that may be incorporated into a fragmenting warhead.

BACKGROUND OF THE INVENTION

Many fragmenting warheads include features designed to attenuate the shock of a detonating explosive (within the warhead) acting against the wall of an outer fragmentation casing. Detonation shock pressures are typically many orders of magnitude greater than the material strength of a fragmentation casing. If not mitigated, the shock waves can overdrive the fragmentation casing causing it to be obliterated into powder instead of usable fragments. Conventional shock mitigation for a fragmentation warhead relies on the inclusion of elastomeric buffer layer(s) or other materials disposed between a fragmentation casing and an explosive fill. The primary limitation of this approach is that these layer(s)/material(s) must be added as a secondary operation after the fragmentation casing or warhead has been fabricated. Such secondary operations are time consuming, add to overall cost, require a certain degree of precision that results in inherent imperfections, and can separate from the final product if not properly installed.

SUMMARY OF THE INVENTION

Accordingly, it is an object of the present invention to provide a shock mitigation body and method for making same.

Another object of the present invention is to provide a monolithic shock mitigation casing and method for making same that can readily be incorporated into a fragmenting warhead.

Other objects and advantages of the present invention will become more obvious hereinafter in the specification and drawings.

In accordance with the present invention, a shock mitigation casing includes a monolithic body made from a solid material. The monolithic body includes a first wall, a second wall spaced apart from the first wall, and axial end walls contiguous with the first wall and the second wall such that a chamber is defined between the first wall, the second wall, and the axial end walls. A powder fills the chamber. The powder is a powdered form of the solid material.

BRIEF DESCRIPTION OF THE DRAWINGS

Other objects, features and advantages of the present invention will become apparent upon reference to the following description of the exemplary embodiments and to the drawings, where corresponding reference characters indicate corresponding parts throughout the several views of the drawings and wherein.

DETAILED DESCRIPTION OF THE INVENTION

Figure 1:
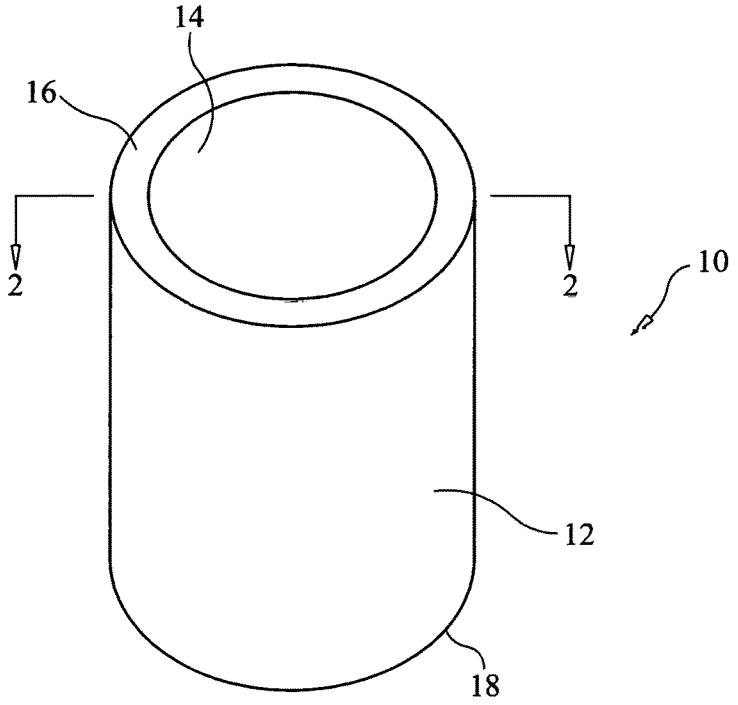
FIG. 1 is a perspective view of a shock mitigation body in accordance with an exemplary embodiment of the present invention.
Figure 2:
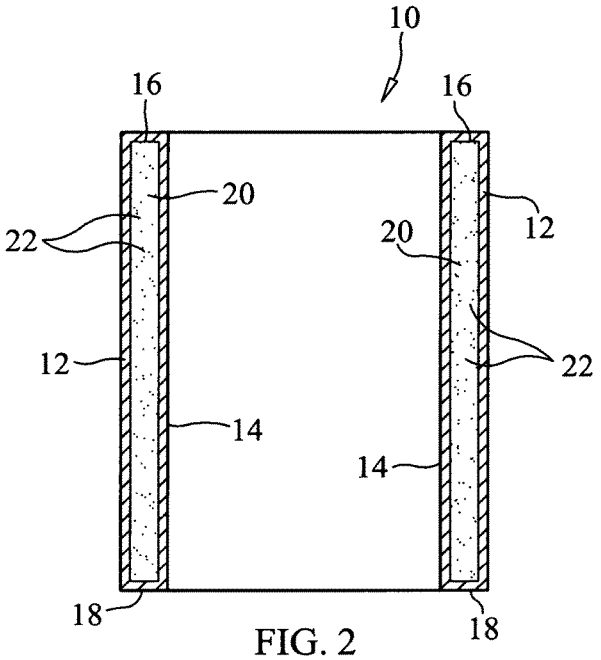
FIG. 2 is an axial cross-sectional view of the shock mitigation body taken along line 2-2 in FIG. 1.

Referring now to the drawings, simultaneous reference will be made to FIGS. 1-2 where a shock mitigation body or casing in accordance with an exemplary embodiment of the present invention is shown and is referenced generally by numeral 10. In the illustrated exemplary embodiment, shock mitigation casing 10 is a hollow tubular structure that is open at either axial end thereof. Shock mitigation casing 10 may be incorporated into a fragmentation warhead where the hollow region of casing 10 defines a volume that would generally be filled with explosive materials (not shown) as would be understood in the art. The choice of explosive material(s) and the configuration or arrangement thereof within the volume defined by casing 10 is not a limitation of the present invention. It is further to be understood that a shock mitigation casing in accordance with the present invention need not be tubular and is not limited to use in fragmentation warheads.

Casing 10 includes a monolithic solid structure that, in general, includes the outer walls of casing 10 in a non-powdered form. More specifically, the monolithic solid structure of casing 10 includes an outer radial wall 12, an inner radial wall 14 spaced radially from outer radial wall 12, and axial end walls 16 and 18 that are contiguous with outer and inner radial walls 12 and 14, respectively. Each of walls 12-18 may be solid throughout their thickness dimension. As a result of this construction, walls 12-18 define an annular chamber 20 as best illustrated in FIG. 2.

Filling annular chamber 20 is a fusable powder material 22 that, as will be explained further below, may be a metal powder, a plastic powder, or a ceramic powder. In general, the material used for powder material 22 is the same material formulation used for walls 12-18 but the material 22 is in a powdered form not a solid form due to the fusion process.

Fabrication of casing 10 may be accomplished using an additive manufacturing process known as powder bed fusion. In some applications, casing 10 will form part of a fragmenting projectile, warhead, missile, etc. In these applications, casing 10 will generally be made from a metal material. Such metals can include aluminum, titanium, steel, stainless steel, Inconel, tungsten, copper, brass, zirconium, magnesium, tantalum, and alloys thereof. However, it is to be understood that the present invention is not limited to the use of these metals as any metal, plastic, ceramic, etc., that lends itself to use in a powder bed fusion process may be used. For example, suitable plastics include a variety of thermoplastic polymer materials to include, but not limited to, nylon, ABS, PVC, polycarbonates, ULTEM, HDEP, etc.

In a powder bed fusion process, a fusable material (e.g., metal, plastic, etc.) is provided in a powdered state. In general, a powder bed fusion process causes a beam of electromagnetic radiation (e.g., laser beam, electron beam, etc.) to be directed towards the bed of fusable powder in accordance with a prescribed plan such that the fusable powder fuses/solidifies into a solid state to define a solid part. The unfused powder is discarded as the finished solid part is removed from the powder bed. However, when casing 10 is fabricated using a powder bed fusion process in accordance with the present invention, annular chamber 20 remains completely filled with unfused, fusable powder material 22. Thus, casing 10 is made completely from the same material as walls 12-18 are the solid state of powder material 22, while annular chamber 20 remains filled with powder material 22.

Casing 10 may be incorporated into a fragmenting warhead by disposing fragmentation elements (not shown) adjacent to outer radial wall 12 and explosive fill material(s) (not shown) within the tubular volume defined by inner radial wall 14. The choice and construction of the fragmentation elements and explosive fill material(s) are not limitations of the present invention. For example, the fragmentation elements could be constructed simultaneously with casing 10 during a powder bed fusion process. The retention of powder material 22 serves to provide improved protection of the fragmentation elements from the shock of detonation of the explosive fill, provide localized blast effects from movement of powder material 22, and may also provide incendiary effects if powder material 22 is reactive.

The advantages of the present invention are numerous. The shock mitigation casing's solid monolithic portion has structural integrity, while the casing's contained powder material provides enhanced localized shock protection and potentially incendiary effects. The single manufacturing process for making the casing from a single material avoids manufacturing defects and costs that are inherent to conventional manufactured casings made from multiple materials. The shock mitigation body/casing described herein may also be used for packaging and personal protection equipment such as helmets (e.g., military helmets, sports helmets, motorcycle helmets, etc.).

Although the invention has been described relative to a specific exemplary embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed is:

1. A shock mitigation casing, comprising:

a monolithic body being made from a solid material, said monolithic body comprises a first wall, a second wall spaced apart from said first wall, and axial end walls contiguous with said first wall and said second wall, wherein a chamber is defined between said first wall, said second wall, and said axial end walls; and a powder filling said chamber, said powder is a powdered form of said solid material, wherein the chamber is a continuous, annular shaped chamber.

2. The shock mitigation casing as in claim 1, wherein said powder is selected from a group of powders susceptible to being fused to a solid form thereof via powder bed fusion.

3. The shock mitigation casing as in claim 1, wherein said powder is selected from one of a metal powder, a ceramic powder, and a plastic powder.

4. The shock mitigation casing as in claim 3, wherein said metal powder comprises a metal selected from the group of aluminum, titanium, steel, stainless steel, Inconel, tungsten, copper, brass, zirconium, magnesium, tantalum, and alloys thereof.

5. The shock mitigation casing as in claim 3, wherein said plastic powder comprises a thermoplastic plastic material.

6. A shock mitigation casing for a warhead, comprising:

an open-ended and hollow monolithic tube being made from a solid material, said monolithic tube comprises an inner radial wall, an outer radial wall spaced apart from said inner radial wall, and axial end walls contiguous with said inner radial wall and said outer radial wall, wherein an annular chamber is defined between said inner radial wall, said outer radial wall, and said axial end walls; and a powder filling said annular chamber, said powder is a powdered form of said solid material, wherein the annular chamber is a continuous, annular shaped chamber.

7. The shock mitigation casing as in claim 6, wherein said powder is selected from a group of powders susceptible to being fused to a solid form thereof via powder bed fusion.

8. The shock mitigation casing as in claim 6, wherein said powder is selected from one of a metal powder, a plastic powder, and a ceramic powder.

9. The shock mitigation casing as in claim 8, wherein said metal powder comprises a metal selected from aluminum, titanium, steel, stainless steel, Inconel, tungsten, copper, brass, zirconium, magnesium, tantalum, and alloys thereof.

10. The shock mitigation casing as in claim 8, wherein said plastic powder comprises a thermoplastic plastic material.

* * * * *